US005472362A

United States Patent [19]

Dandurand

[11] Patent Number: 5,472,362

[45] Date of Patent: Dec. 5, 1995

[54] BUOYANT APPARATUS FOR AQUATIC RECREATION

[76] Inventor: William Dandurand, 20639 Hatton St., Canoga Park, Calif. 91306

[21] Appl. No.: 349,210

[22] Filed: Dec. 5, 1994

[51] Int. Cl.[6] ..... B63B 1/00

[52] U.S. Cl. ..... 441/65

[58] Field of Search ..... 441/65; 114/242, 114/246, 253

[56] References Cited

U.S. PATENT DOCUMENTS 5,116,269 5/1992 Moran ..... 441/65

FOREIGN PATENT DOCUMENTS 2014754 10/1971 Germany ..... 441/74

2196306 4/1988 United Kingdom ..... 441/65

*Primary Examiner*—Jesús D. Sotelo

*Attorney, Agent, or Firm*—Elliott N. Kramsky

[57] ABSTRACT

Apparatus for recreational use in an aquatic medium. A buoyant body includes a depressed region adapted to receive the body of a user in a preferred recreational posture. Handles are provided, anchored in the deck of the apparatus, for grasping by the user, allowing the less-than-expert to obtain maneuverability and enjoy surfing-type sports.

9 Claims, 2 Drawing Sheets

FIG. 1
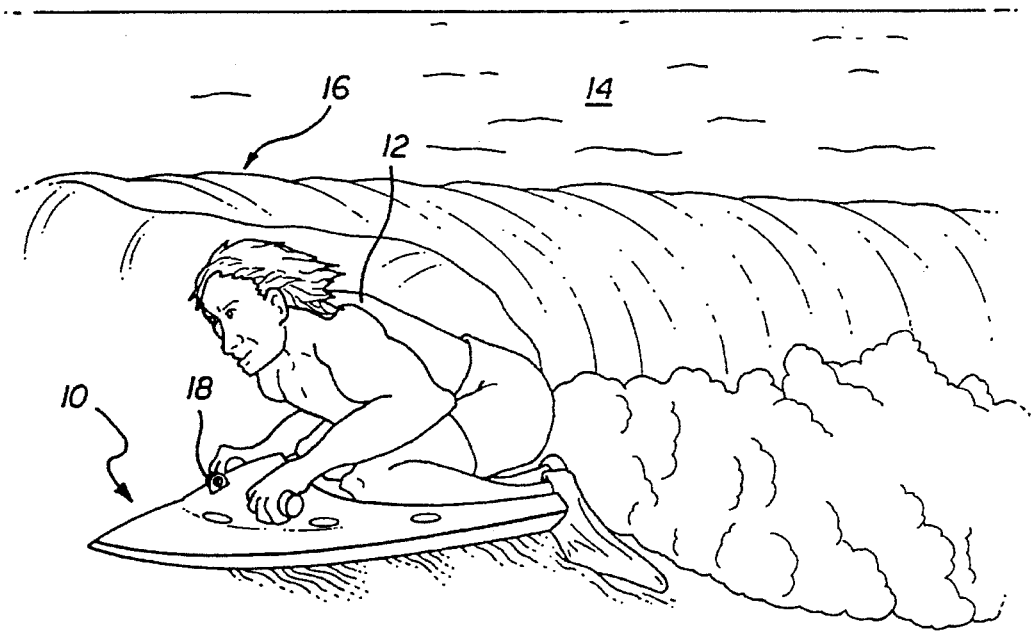
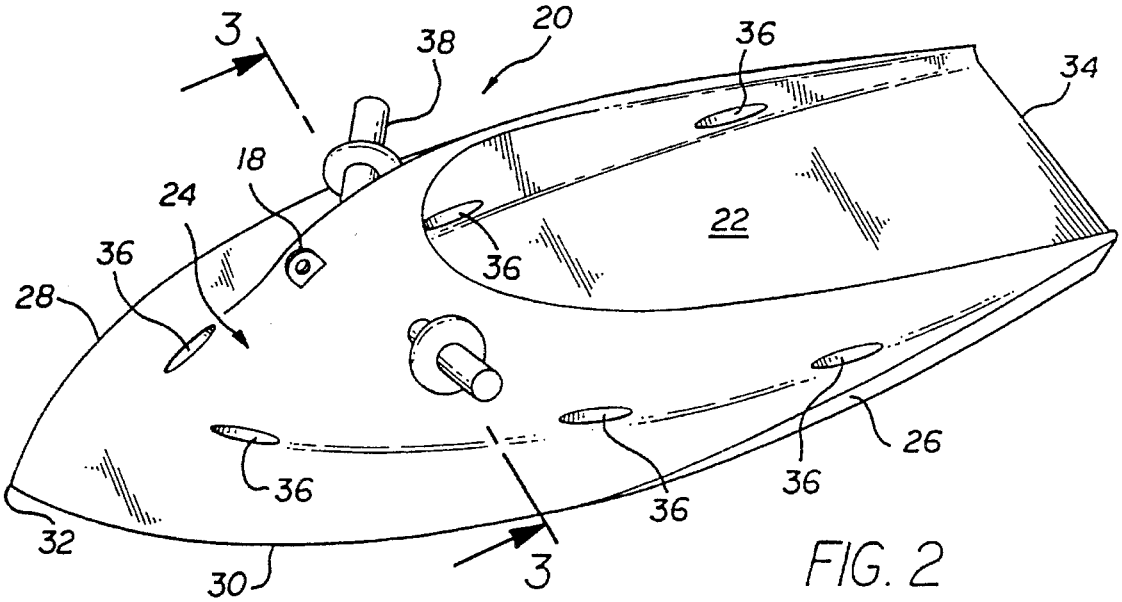
FIG. 2

FIG. 3
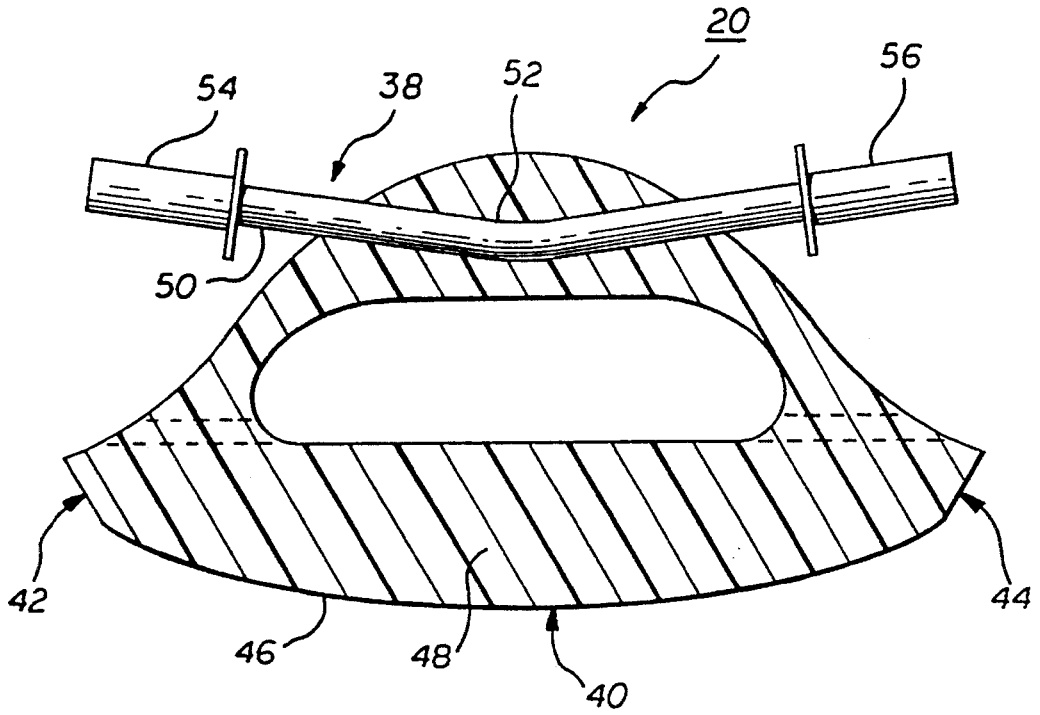
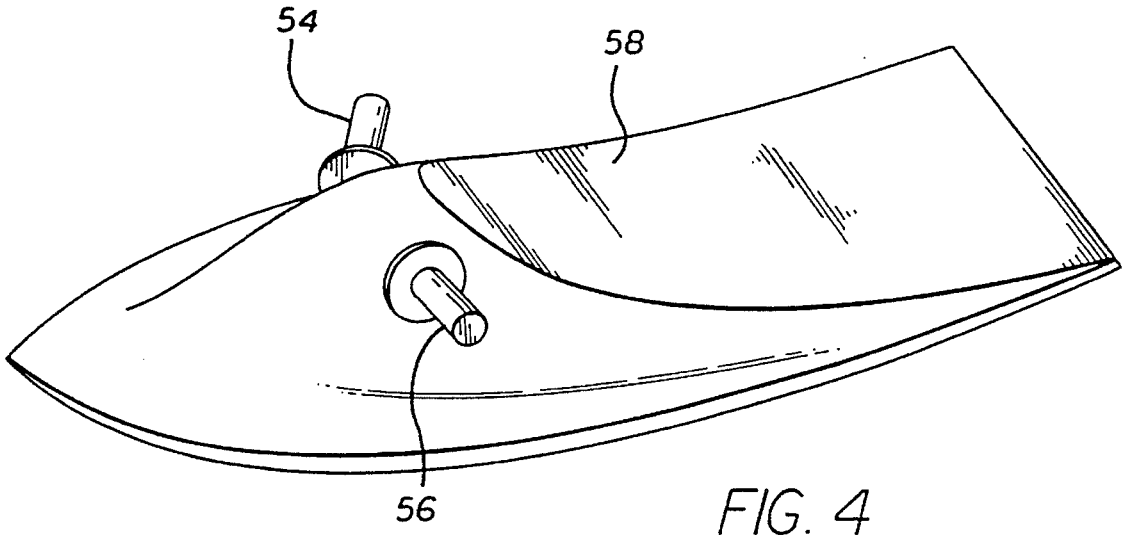
FIG. 4

BUOYANT APPARATUS FOR AQUATIC RECREATION

BACKGROUND

1. Field of the Invention

The present invention relates to a buoyant recreational flotation apparatus. More particularly, this invention pertains to a board-like device adapted to accommodate the body of a recreational user.

2. Description of the Prior Art

Numerous water sports, requiring skill and offering pleasurable recreation, require equipment suitable for the joint purposes of (1) buoyantly supporting the recreational user and (2) appropriately traveling through or transversing the aquatic medium.

With the exception of boating apparatus falling generally within the above parameters, the most thrilling and skillful aquatic diversions require equipment of sufficiently simple design and compact size to permit the user to act in concert with his equipment as a unitary, maneuverable body. Representative water sports include, but are not limited to, jet skiing, surfing, water skiing and board sailing.

"Body boarding" an offshoot, or "poor cousin", of classic surfing, has experienced a significant amount of popularity. This sport requires a board-like flotation device to support a prone user as he "rides" a wave as it cascades and then breaks at a beach. The sport thus constitutes a hybrid of the classic or erect surfing and the prone and boardless body surfing experience.

While body boarding offers a pleasurable experience for the recreational user, present-day equipment principally provides flotation, lacks maneuverability and adds little to the enjoyment of boardless body surfing.

SUMMARY AND OBJECTS OF THE INVENTION

It is therefore an object of the present invention to provide flotation apparatus suitable for aquatic sports that offers the recreational user substantial additional maneuverability.

It is yet another object of the present invention to provide such apparatus which is further suitable for both wave-powered and towed recreations.

It is yet still another object of the present invention to provide apparatus as described above that permits various recreational postures.

The preceding and other objects are addressed and attained by the present invention which provides a flotation apparatus for aquatic recreation. Such apparatus includes a buoyant body. Such body includes a region at the upper surface thereof adapted to receive a user. A handle is engaged to the body. Such handle is arranged for grasping by the user while supported by the body.

The preceding and other features and advantages of the invention will become further apparent from the detailed description that follows. Such description is accompanied by a set of drawing figures. Numerals of the drawing figures, corresponding to those of the written text, point to the features of the invention. Like numerals refer to like features throughout both the written text and the drawing figures.

BRIEF DESCRIPTION OF THE DRAWINGS

FIG. 1 is a perspective view of the flotation apparatus of the invention supporting a recreational user in operation (squat-like posture);

FIG. 2 is a detailed perspective view of the flotation apparatus of the invention;

FIG. 3 is a cross-sectional view of the body of the flotation apparatus of the invention taken at section line 3—3 of FIG. 2; and FIG. 4 is a perspective view of an alternative embodiment of the invention arranged to receive a recreational user in a substantially-prone posture.

DETAILED DESCRIPTION

Turning now to the drawings, FIG. 1 is a perspective view of the flotation apparatus 10 of the invention in operation. As shown, the apparatus 10 is employed in FIG. 1 by a user 12 while assuming a substantially squat-like posture to navigate through a non-placid aquatic medium 14, such as the ocean, to "ride" (i.e., usurp the power of) a wave 16. While illustrated in FIG. 1 with regard to a wave-propelled use, the present invention is also suitable for towed usage as provided, for example, by a motor boat. An eyelet 18, preferably of metallic fabrication, is anchored to the deck of the apparatus 10 for attachment to a tow line (not shown).

FIG. 2 is a detailed perspective view of the flotation apparatus 10 of the invention. Referring to FIGS. 1 and 2 in combination, one can see that the apparatus 10 comprises a body 20, preferably of buoyant pressed polyurethane, that has been molded into a shape appropriate for accommodating the recreational user 12 in a selected recreational posture. A depression 22 is formed within the deck of the body 20 for receiving the knees and shins of the user 12 in accordance with the posture illustrated in FIG. 1. In an alternative embodiment, described below, the depression is adapted to receive the upper body of the user 12, permitting the recreational user to assume a more-or-less prone posture.

The body 20 is generally apportioned between an upper deck 24 and a hull 26. Symmetrical, opposed arcuate sides 28 and 30 of the body define a pointed bow 32 and a substantially straight keel 34. Ports 36 may be optionally provided for drainage purposes.

As show in FIG. 1, a handle 38 is provided for grasping by the user during use. The handle 38 provides a distinct advantage. The handle 38 provides both a means for grasping and stabilizing one's position and attitude while "at the mercy" of a wave 16 or of a towing boat's wake. Additionally, the handle 38 provides the less-than-advanced user 12 with a means for maneuvering the apparatus 12 without employing or requiring the skilled balancing techniques of classic erect surfing.

FIG. 3 is a cross-sectional view of the body 20 taken at section line 3—3 of FIG. 2. As can be seen, the hull 26 includes a central, gently arcuate or convex portion 40 that is bordered at its edges by inclined side sections 42 and 44. The inclined side edges 42 and 44 provide a shape that is suitable for "edging" motion into a wave 16 as shown in FIG. 1. Further, by inclining the edges 42 and 44, the apparatus 10 is made readily steerable under the influence of torsion applied to the handle 38 by a recreational user. The hull is coated with a layer of high density polyurethane 46 that acts as a sealant of the buoyant pressed polyurethane 48 of the remainder of the body 20.

Seen in cross-section, the handle 38 comprises a tubular piece 50 that is anchored within an elevated region of the upper deck of the body 20 by means of an appropriate adhesive 52. The tubular piece 50 is terminated at either end by hand holds 54 and 56 for grasping in the manner illustrated in FIG. 1.

FIG. 4 is perspective view of an alternative embodiment of the invention. As discussed above, the embodiment of FIG. 4 differs from that of the prior figure in that the depression 58 of the upper deck of the body is arranged for receiving the upper body, as opposed to the knees and shins, of a user. Unlike the configuration shown in FIGS. 1 and 2, the embodiment of FIG. 4 is adapted to support a recreational user while lying substantially prone and grasping the hand holds 54 and 56.

While this invention has been described with reference to its presently preferred embodiment, it is not limited thereto. Rather, this invention is limited only insofar as it is defined by the following set of patent claims and includes within its scope all equivalents thereof.

What is claimed is:

1. Flotation apparatus for aquatic recreation comprising, in combination:

a) a buoyant body having a longitudinal axis and comprising an upper deck that includes an elevated region and a hull that includes a convex central portion joined to inclined edge portions;

b) said upper deck including a distinct region adjacent said elevated region adapted to receive a user; and c) a handle comprising an elongated tubular piece having a central portion fixed within said elevated region and arranged substantially transverse to said axis whereby opposed end segments thereof protrude therefrom to form a pair of hand holds.

2. Flotation apparatus as defined in claim 1 wherein said body is additionally characterized in that:

a) the bow of said body is pointed; and b) the keel of said body is substantially straight.

3. Flotation apparatus as defined in claim 1 further characterized in that said elevated region includes a transverse channel for receiving said elongated tubular piece.

4. Flotation apparatus as defined in claim 3 wherein said distinct region comprises a depression.

5. Flotation apparatus as defined in claim 4 wherein said depression is arranged to receive the legs of a user.

6. Flotation apparatus as defined in claim 4 wherein said depression is adapted to receive the upper body region of said user.

7. Flotation apparatus as defined in claim 4 further characterized in that:

a) a partially-encircling wall defines said depression; and b) said wall has at least one drainage port.

8. Flotation apparatus as defined in claim 7 wherein said wall has a plurality of drainage ports arranged symmetrically with respect to said axis.

9. Flotation apparatus as defined in claim 1 further including an eyelet affixed to-said upper deck for receiving a tow rope.

* * * * *